US006494747B1

(12) United States Patent
Hwang

(10) Patent No.: US 6,494,747 B1
(45) Date of Patent: Dec. 17, 2002

(54) ADAPTER SOCKET

(76) Inventor: Lih-Jiuan Hwang, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/587,795

(22) Filed: Jun. 6, 2000

(51) Int. Cl.[7] ..... H01R 33/76
(52) U.S. Cl. ..... 439/676; 439/638
(58) Field of Search ..... 439/638, 676, 439/418

(56) References Cited

U.S. PATENT DOCUMENTS 4,241,974 A * 12/1980 Hardesty ..... 439/638
4,444,451 A * 4/1984 Myers ..... 439/638
5,328,390 A * 7/1994 Johnston et al. ..... 439/638

* cited by examiner

*Primary Examiner*—Gary Paumen

(57) ABSTRACT

An adapter socket, the structural design of which is comprised of an adapter socket body, a cover plate, and a plurality of connection terminals. A containment recess is disposed along the center of the adapter socket body, a number of separator elements are situated at the front end of the said containment recess, and a receptacle is formed at the rear end such that when the connection terminals are installed into the containment recess of the adapter socket body, the front ends of the prongs are ensconced between the separator elements, while the rear ends of the contiguous leads are arrayed into a staggered up and down, left to right arrangement. The cover plate is then fastened over the connection terminals to secure them firmly in position without allowing mutual contact. As such, utilizing the said structural components not only reduces fabrication cost, but provides for easy and rapid assembly and, furthermore, prevents incorrect assembly.

1 Claim, 5 Drawing Sheets

ADAPTER SOCKET

BACKGROUND OF THE INVENTION

1) Field of the Invention

The invention herein relates to an adapter socket design, specifically a structural design consisting of a modular plug adapter that enables the conversion of a United States telephone plug into a United Kingdom telephone plug and in which the contiguous leads of a plurality of connection terminals are disposed in a staggered arrangement, with separator elements and a cover plate securely maintaining the physical configuration. The present invention also prevents assembly errors due to component confusion and, furthermore, can be easily and rapidly completed.

2) Description of the Prior Art

Referring to FIG. 1 and FIG. 2, a conventional United States telephone adapter socket is comprised of a male plug 10, an end cap 20, a receptacle 30, an adapter socket body 40, and signal wiring 50; the said signal wiring 50 consists of electrical wires 502 fixed to the trailing ends of a plurality of connection terminals 501 that are conjoined to a number of conductive pins 503; as such, during the assembly process, the connection terminals 501 at the ends of the signal wiring 50 are first embedded into the male plug 10 and then, the conductive pins 503 of the electrical wires 502 are routed through the opening of the end cap 20 and the male plug 10 is sleeved onto the end cap 20, enabling each of the arranged conductive pins 503 to be inserted into the receptacle 30 and the outward bending of the trailing ends of the conductive pins 503; the said receptacle 30 is next inserted into the adapter socket body 40; finally, the end cap 20 is assembled to the adapter socket body 40 to form a single structural entity, thereby completing the adapter socket. However, the structure of the said adapter socket requires numerous components and procedures to complete its assembly; the degree of difficulty involved is obviously higher and, furthermore, is overly complicated such that production cost is increased. Additionally, when the conductive pins 503 are inserted into the receptacle 30, since insertion must be executed according to the color of the electrical wires 502, incorrect insertion by assembly personnel frequently occurs due to fatigue and other factors, which results in an increased defect rate that adversely affects production capability.

Therefore, the inventor of the invention herein in the spirit of refinement and innovation researched and developed an adapter socket, the structural design of which consists of an adapter socket comprised of an adapter socket body, a cover plate, and a plurality of connection terminals, wherein the contiguous leads of the connection terminals are arrayed in a staggered up and down, left to right arrangement inside the adapter socket body, with the cover plate then fastened over the top end to enclose and secure the connection terminals firmly into position without allowing mutual contact, an approach that not only significantly reduces the number of required components, but also provides for a simpler assembly procedure that greatly minimizes defect rates.

SUMMARY OF THE INVENTION

The primary objective of the invention herein is to provide an adapter socket, the structural design of which is comprised of an adapter socket body, a cover plate, and a plurality of connection terminals; a containment recess is disposed along the center of the adapter socket body, a number of separator elements are situated at the front end of the said containment recess, and a receptacle is formed at the rear end such that when the connection terminals are installed into the containment recess of the adapter socket body, the front ends of the prongs are ensconced between the separator elements and the rear ends of the contiguous leads are arrayed into a staggered up and down, left to right arrangement; the cover plate is then fastened over the connection terminals to secure them firmly in position without allowing mutual contact; as such, utilizing the said structural components not only reduces production cost, but provides for easy and rapid assembly and, furthermore, prevents incorrect assembly.

The structural features and other functional aspects of the invention herein are introduced in the brief description of the drawings below and further elaborated by the accompanying detailed description of the invention herein.

DETAILED DESCRIPTION OF THE INVENTION

Figure 1:
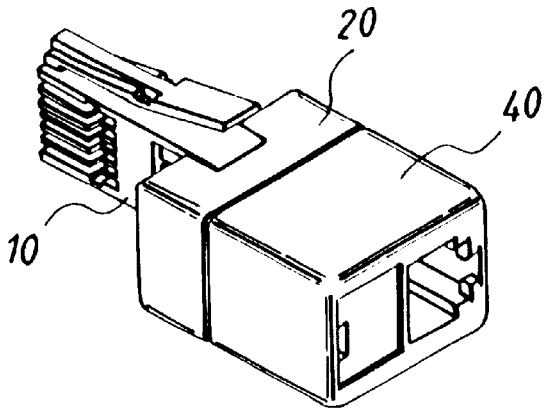
FIG.1 Prior Art
FIG. 1 is an isometric drawing of a conventional adapter socket.
Figure 2:
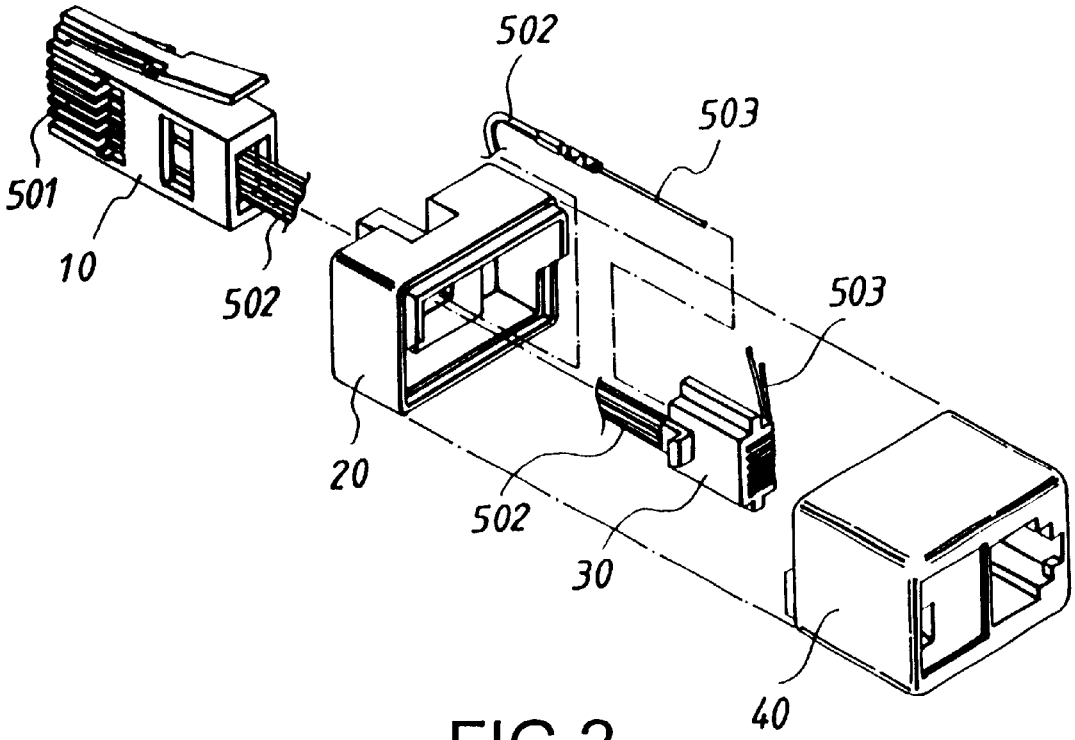
FIG.2 Prior Art
FIG. 2 is an exploded drawing of a conventional adapter socket.
Figure 3:
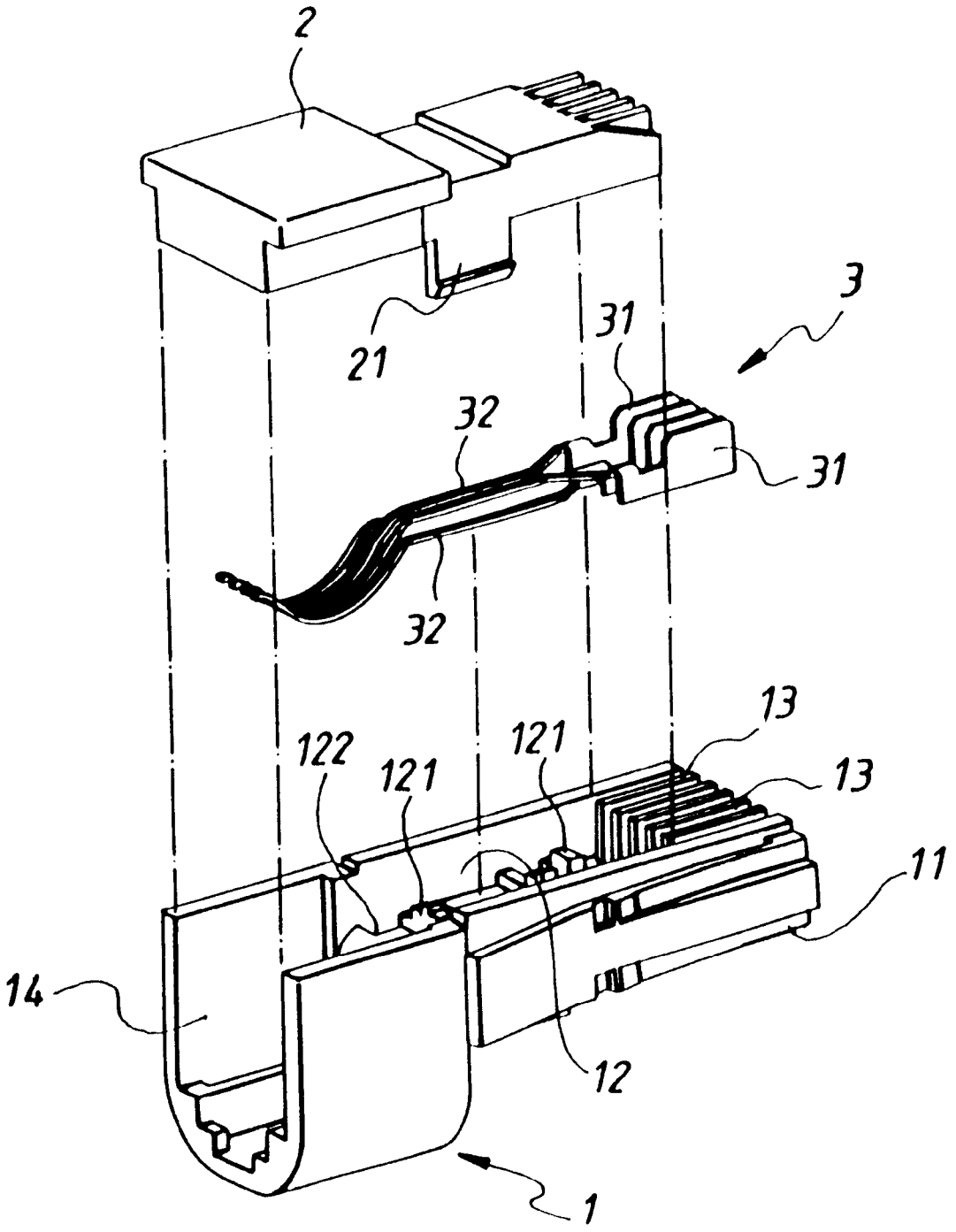
FIG. 3 is an exploded drawing of the invention herein.
Figure 4:
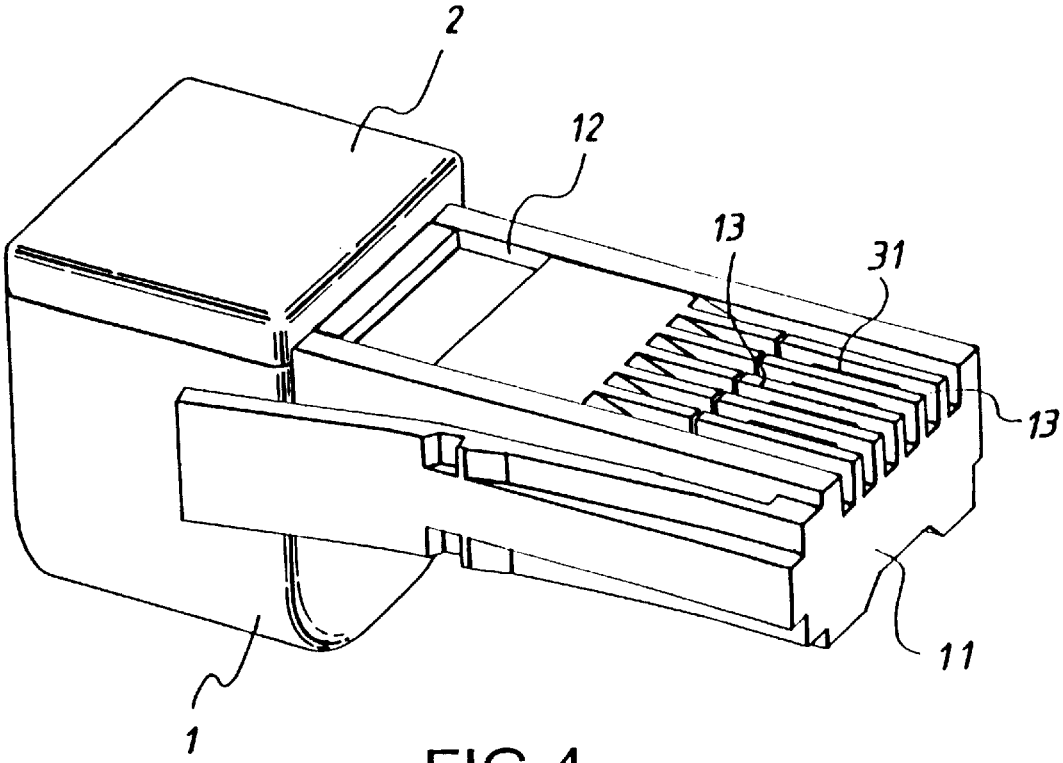
FIG. 4 is an isometric drawing of the invention herein.
Figure 5:
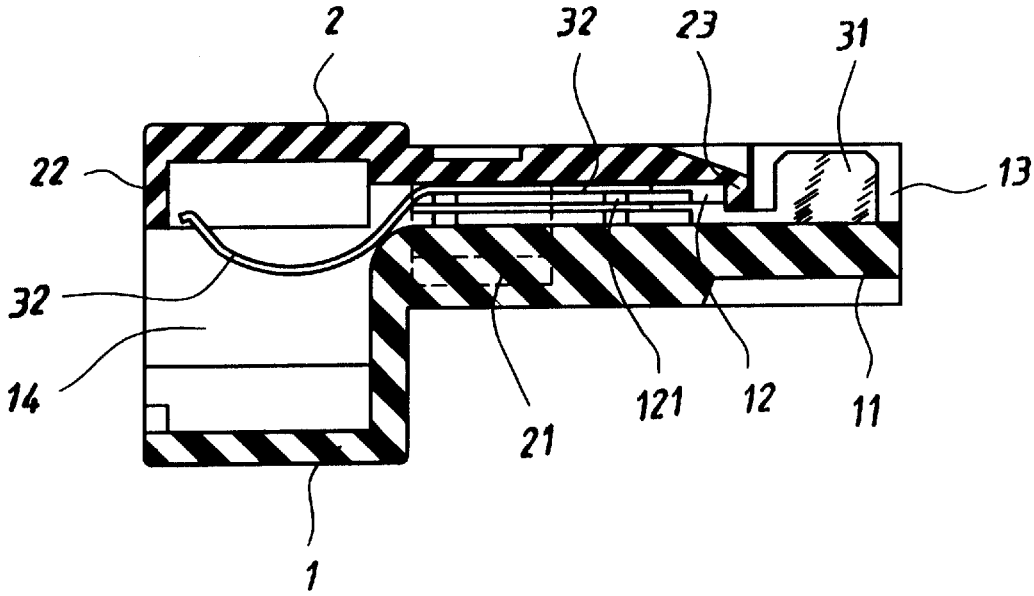
FIG. 5 is a cross-sectional drawing of the invention herein.

Referring to FIG. 3, FIG. 4, and FIG. 5, the adapter socket design of the invention herein is comprised of an adapter socket body 1, a cover plate 2, and a plurality of connection terminals 3, of which:

The adapter socket body 1 is of one-piece molded construction and has a United Kingdom modular telecommunications plug 11 formed on one end and a containment recess 12 disposed along the center of the plug 11; a number of separator elements 13 are situated at the front end of the said containment recess 12 and a receptacle 14 is formed at the rear end thereof and, furthermore, a number of support plates 121 are molded on the bottom section of the containment recess 12 and a notch 122 is formed at a designated area in each of two sides thereof.

Figure 6:
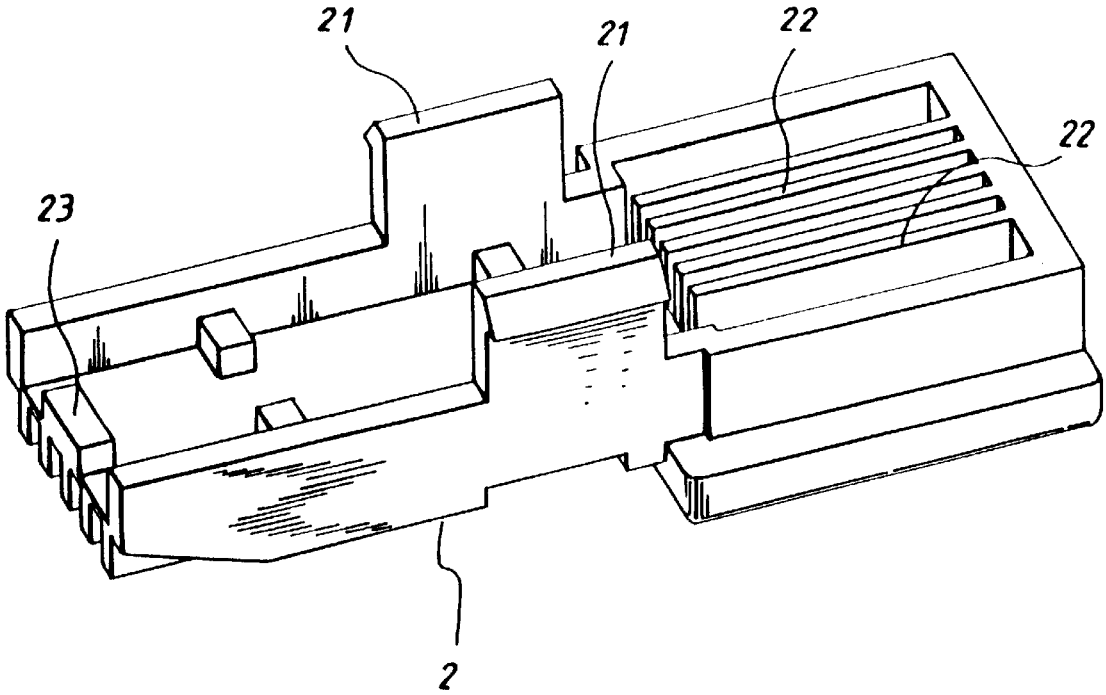
FIG. 6 is an isometric drawing of the cover plate as viewed from another perspective.

The cover plate 2, as indicated in FIG. 3 and FIG. 6, is of a flat profile and has a hooked appendage 21 extending downward from the center of two sides thereof, with a number of separator plates 22 formed along the bottom surface at the front section thereof and a support element 23 formed horizontally on the bottom surface at the rear section.

Figure 7:
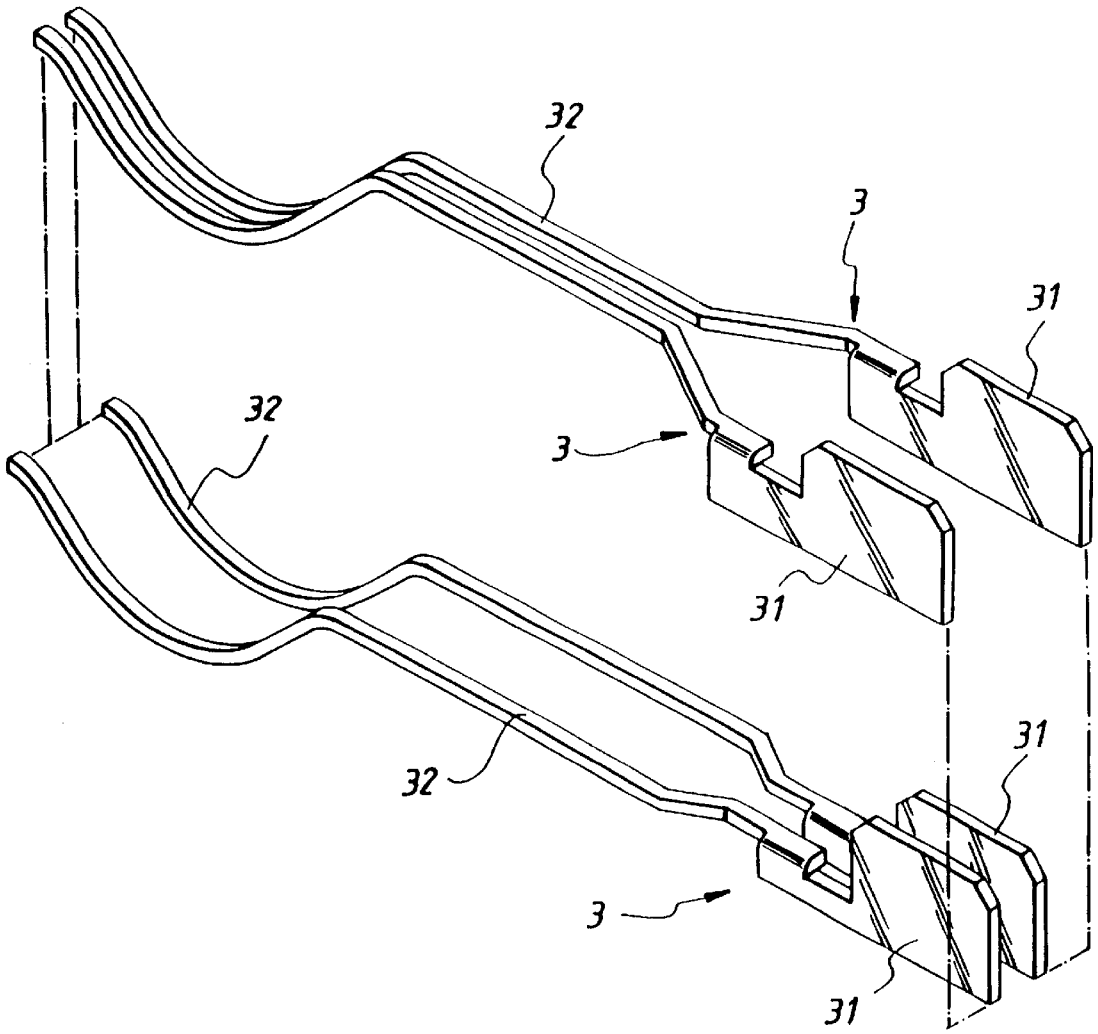
FIG. 7 is an isometric drawing of the connection terminal array of the invention herein.

The connection terminals 3, as indicated in FIG. 3 and FIG. 7, each have a vertically oriented prong 31 at the front end thereof and a curved, planar oriented contiguous lead 32 of a designated height at the rear end and, furthermore, each of the said contiguous leads 32 have a left and right horizontal deflection at a designated point and the trailing ends of the contiguous leads 32 are fabricated in the shape of a curve.

Utilizing the said structural components, the plurality of the connection terminals 3 are placed into the corresponding positions within the containment recess 12 of the adapter socket body 1 such that front ends of the prongs 31 are ensconced between the separator elements 13 and the rear ends of the contiguous leads 32 are arrayed into a staggered up and down, left to right arrangement and braced on the support plates 121; furthermore, the trailing ends extend along the containment recess 12 up to the receptacle 14 and the said cover plate 2 is positioned over the top end of the adapter socket body 1 such that the support element 23 presses against the upper extent of the connection terminals 3 and thereby maintains the trailing ends of the contiguous leads 32 between the separator plates 22 and, furthermore, the hooked appendages 21 of the cover plate 2 engage the notches 122, thereby fastening the cover plate 2 to the adapter socket body 1 and securing the contiguous leads 32 firmly in position without mutual contact; as such, not only is production cost reduced, but assembly is easy and rapid and, furthermore, incorrect assembly is prevented.

Furthermore, due to the flexural contact area between the contiguous leads 32 of the connection terminals 3 and the terminals themselves and, furthermore, the curved shape of the trailing ends, when the contiguous leads 32 are situated flush against the embedded conductors of a telephone plug, elastically loaded contact is provided that enables stable and, furthermore, noise-free signal transmission.

In summation of the foregoing section, since the adapter socket of the invention herein is original, capable of fully achieving its design objectives, practical, and progressive, therefore, the present invention is reasonably innovative and meets new patent application requirements and is hereby lawfully submitted to the patent bureau for review and the granting of the commensurate patent rights.

What is claimed is:

1. An adapter socket comprising an adapter socket body, a cover plate, and a plurality of connection terminals, wherein:

said adapter socket body is of one-piece molded construction and has a plug formed on one end and a containment recess disposed along the center of said plug plurality of separator elements are situated at front end of said containment recess and a receptacle is formed at rear end thereof and, furthermore a plurality of support plates are molded on the bottom section of said containment recess and a notch is formed at a designated area in each of two sides thereof;

said cover plate is of a flat profile and has a hooked appendage extending downwardly from the center of two sides thereof, with a plurality of separator plates formed along the bottom surface at the front section thereof and a support element formed horizontally on the bottom surface at the rear section thereof;

said connection terminals each have a vertically oriented prong at front end and thereof a curved, planar oriented contiguous lead of a designated height at a rear end thereof and, each of said contiguous leads have a left and a right horizontal deflection at a designated point and trailing ends of said contiguous leads are fabricated in the shape of a curve;

of said connection terminals are placed into corresponding positions within said containment recess of said adapter socket body such that front ends of said prongs are enclosed between said separator elements and the rear ends of said contiguous leads are arrayed in a staggered up and down, left to right arrangement and braced on said support plates; the trailing ends project along said containment recess up to the said receptacle and the said cover plate is positioned over a top end of said adapter socket body such that said support element presses against an upper extent of said connection terminals and thereby maintains the trailing ends of said contiguous between said separator plates and, said hooked appendages of said cover plate engage said notches, thereby fastening said cover plate to said adapter socket body and securing said contiguous leads firmly in position without mutual contact.

* * * * *